US005100253A

United States Patent [19]

Cooper

[11] Patent Number: 5,100,253

[45] Date of Patent: Mar. 31, 1992

[54] CONCEALED RIVET ELEMENT AND SETTING METHOD FOR BINDER AND THE LIKE

[75] Inventor: Edward W. Cooper, Scarborough, Canada

[73] Assignee: ACCO World Corporation, Wheeling, Ill.

[21] Appl. No.: 709,727

[22] Filed: Jun. 3, 1991

[51] Int. Cl.[5] ..... B42F 13/00

[52] U.S. Cl. ..... 402/75; 402/80 R

[58] Field of Search ..... 402/73, 75, 80 R, 502

[56] References Cited

U.S. PATENT DOCUMENTS 2,052,665 9/1936 Schade ..... 402/75
2,632,657 3/1953 Schade ..... 402/75 X
4,582,442 4/1986 Rager ..... 402/75
4,697,945 10/1987 Geiger ..... 402/75
5,035,526 7/1991 Cooper et al. ..... 402/75

*Primary Examiner*—Paul A. Bell
*Attorney, Agent, or Firm*—Pennie & Edmonds

[57] ABSTRACT

A binder assembly having a backing, which may be the spine or cover, with a prong-carrying plate or plates secured to the backing by means of the prongs. Upstanding rivets secure a support means to the plates. The support means may support a ring binder mechanism, a binder clamp mechanism or other binder mechanism. The support means is secured to the assembly by deforming the heads of the rivets. The rivets and plates may be secured together by assembly and swaging. Spacer elements may be positioned between the plate or plates and the arcuate casing of a ring binder mechanism.

13 Claims, 3 Drawing Sheets

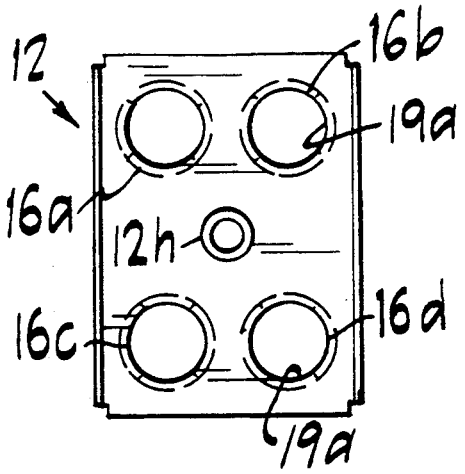
FIG.2
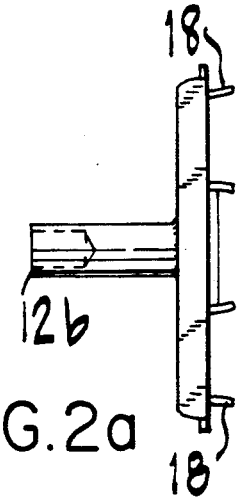
FIG.2a
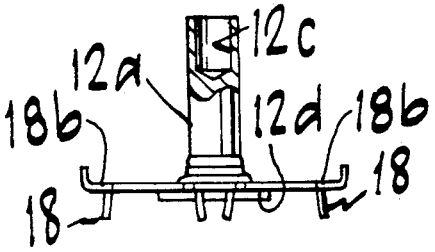
FIG.2b
FIG.3
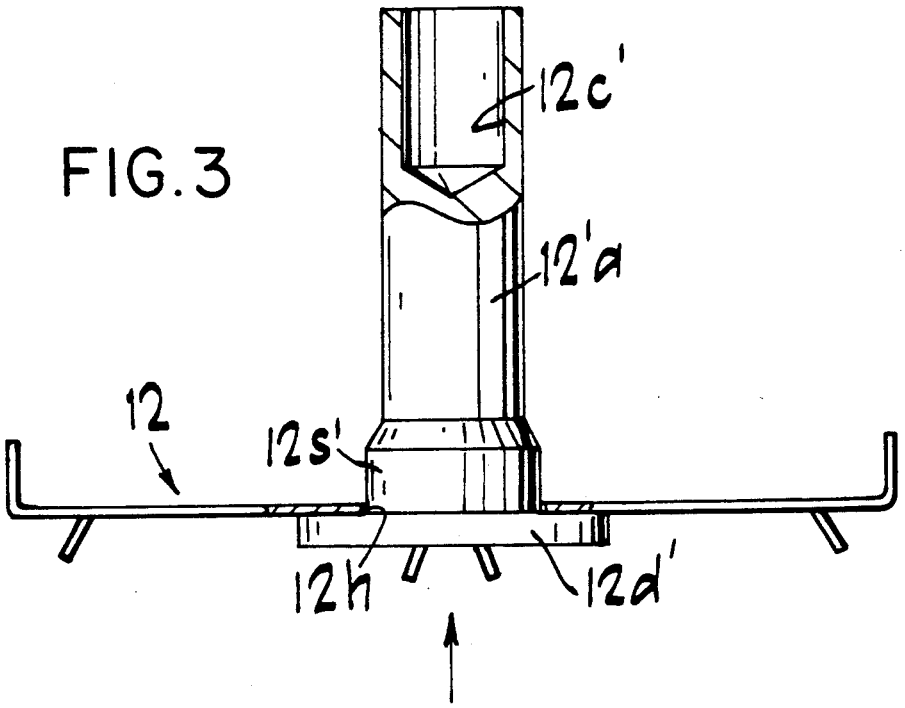

CONCEALED RIVET ELEMENT AND SETTING METHOD FOR BINDER AND THE LIKE

BACKGROUND OF THE INVENTION

Prior binder mechanisms have used metal strips engageable with the spines using prongs (U.S. Pat. Nos. 1,709,955 and 4,697 945). Binder backs have included eyelets and rivets (U.S. Pat. Nos. 2,709,955, 1,787,958 and 2,632 657), and rivets have been embedded in spines to hold metal ring hardware (U.S. Pat. No. 4,582,442).

None of these prior art mechanisms is constructed using a rivet and spiked plate arrangement to secure conveniently and economically the spine and arcuate casings together.

SUMMARY OF THE INVENTION

Broadly, the invention comprises binder assembly having a plate or plurality of plates with prongs for staking the plate or plates to a backing, such as the spine of a binder. An upstanding deformable rivet is mounted on each plate or plates. The rivets secure an arcuate ring binder casing or other support member to the backing. The casing or other support member has holes to receive the blank rivets during assembly and thereafter the rivets are deformed to retain the casing or member on the rivets. Tubular space anvil supports may be used to accommodate the space between the plate or plates and the arcuate casing.

BRIEF DESCRIPTION OF THE DRAWINGS

FIG. 2 is a plan view of the plate assembly;

FIG. 2*a* is a side elevation of the plate assembly;

FIG. 2*b* is a front elevation, partially cutaway of the plate assembly;

FIG. 3 is a side elevational view of an alternative rivet to the plate assembly;

DESCRIPTION OF THE PREFERRED EMBODIMENTS

Figure 1:
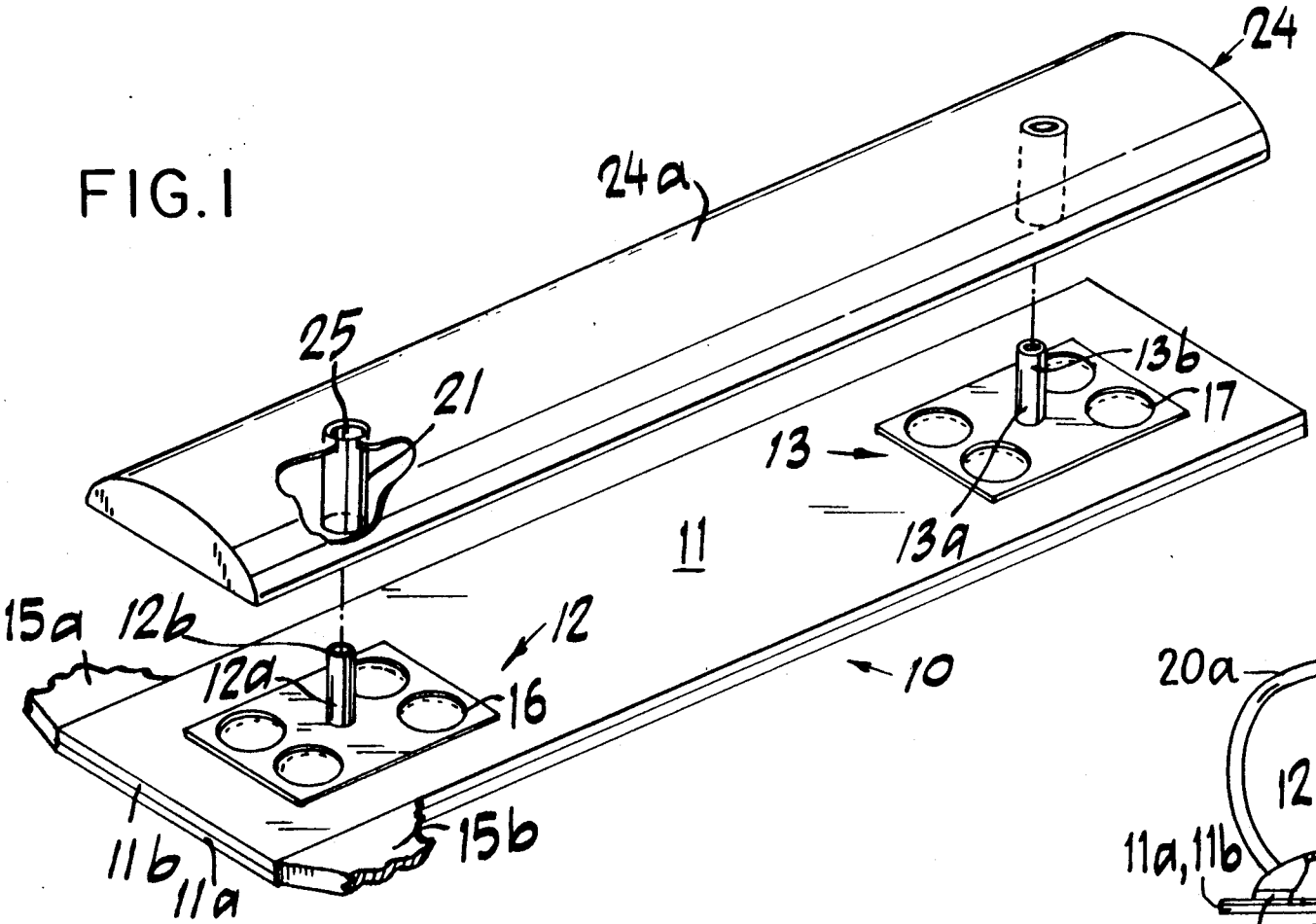
FIG. 1 is an exploded perspective view of a ring binder embodiment of the invention.

Referring to FIG. 1, ring binder 10 includes layered spine 11 with a board spine layer 11*a* and upper vinyl layer 11*b*. Partial covers 15*a*, 15*b* are also shown. Driven into each end portion of spine 11 are anchor plate assemblies 12, 13 with each plate having four (4) burst prong groups 16, 17 including individual prongs 18 in each group (FIG. 2*a*). The bases of each group of prongs 18 are positioned in a circle. Other configurations of prongs, such as a square arrangement, are also useful.

Prongs 18 are driven through vinyl layer 11*b* and embedded in layer 11*a*. Alternatively, vinyl layer 11*b* may be omitted, with prongs 18 being directly embedded in layer 11*b*. Prongs 18 have sharp ends substantially equal to the thickness of spine 11, but do not exit the spine 11 when fully driven. A single elongated plate assembly may be used instead of the two spaced-apart plate assemblies 12, 13 here shown.

Figure 1A:
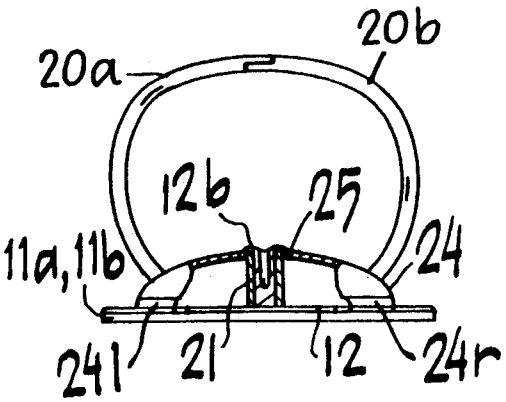
FIG. 1*a* is a partial cutaway end view of the ring binder embodiment of FIG. 1.

Each plate 12, 13 has vertical upstanding deformable rivets 12*a*, 13*a* staked or otherwise secured to it. Referring to FIG. 1, hollow cylindrical spacer anvil tubular supports 21, 22 are welded or otherwise attached to and depend from ring casing 24. Alternatively, supports 21, 22 may be positioned between spine 11 and casing 24 without attachment to each other. Spacer anvil supports 21, 22 of large enough diameter to be placed concentrically around rivets 12*a*, 13*a*. As assembled, rivet heads 12*b*, 13*b* extend about top casing surface 24*a*. Rivet heads 12*b*, 13*b* are deformed to secure casing 24 and its depending attachment to plates 12, 13 (see FIG. 1*a*). Anvil supports 21, 22 serve to distance selectively the casing 24 from spine 11 and to provide anvil stability. If other removable supports and spacers are used during assembly, spacer anvil supports 21, 22 can be dispensed with. Rivet portions 12*b*, 13*b* are more readily deformable because they include recesses 12*c*, 13*c* before deformation. Ring halves 20*a*, 20*b* are also shown. Casing 24 includes lower casing portions 24*r*, 24*l* which contact spine 11.

As is known in the art, it is sometimes desirable to locate the ring halves and casing on the back cover, adjacent to the hinge area, instead of on the spine. This may be easily accomplished according to the teachings of the present invention by simply securing anchor plate assemblies 12, 13 to the cover 15*b* instead of sine 11.

Turning to FIGS. 2, 2*a* and 2*b*, plate 12 is shown in more detail including plate hole 12*h*. Bursts 16*a*–*d* are formed by bending from circular areas 19*a* in plate 12.

Figure 4:
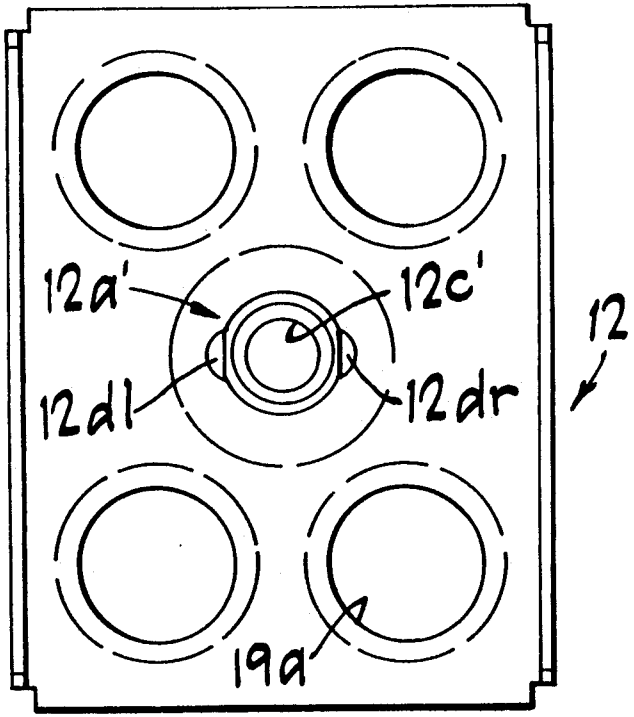
FIG. 4 is a plan view of the alternative assembly of FIG. 3 after swaging.

FIGS. 3 and 4 show an assembly and attachment of alternative upstanding rivets 12*a*', 13*a*' to their respective anchor plates 12, 13 may be accomplished by inserting rivet 12*a* upwardly (see arrow of FIG. 3) through plate hole 12*h* until collar 2*d*' engages the bottom of plate assembly 12 (FIG. 3). Also shown in recess 12*c*' and rivet swagable portion 12*s*' which passes through hole 12*h*. The required depth of recess 12*c*' may vary depending on the particular application; it may comprise a cylindrical passage through rivet 12*a*'. Once assembled, swagable portion 12*s*' is partially swaged at diametrical areas 12*dr*, 12*dl* to the configuration shown in FIG. 4 to secure rivet 12*a*' to plate 12. Rivet 13*a* may be similarly attached to plate 13.

Figure 6:
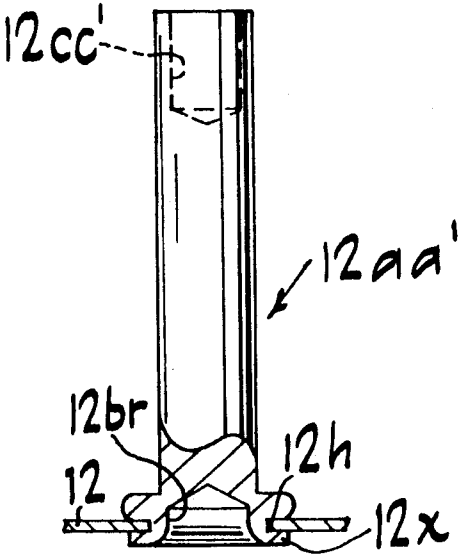
FIG. 6 is a view similar to FIG. 5 after swaging.
Figure 5:
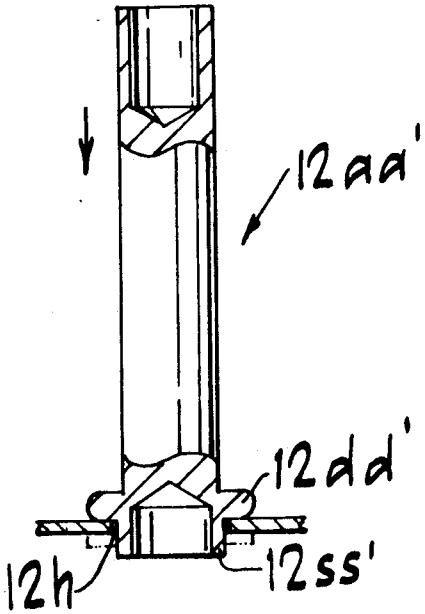
FIG. 5 is an elevational view of another alternative rivet to the plate assembly.

As a further alternative, rivet 12*aa*' may have collar 12*dd*' positioned to engage the upper surface of plate assembly 12 when inserted from above (see arrow of FIG. 5) as swagable portion 12*ss*' passes through hole 12*h*. To complete assembly, portion 12*ss*' is swaged to the deformed configuration 12*x* shown in FIG. 6. Also shown is bottom rivet recess 12*br* and upper recess 12*cc*'.

Figure 7:
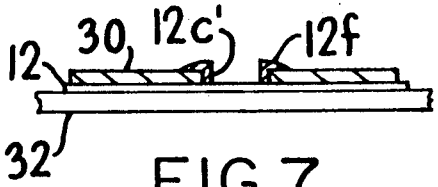
FIG. 7 is a partial cross-sectional view of a further alternative embodiment of the invention.

FIG. 7 illustrates another alternative embodiment of the invention. In this embodiment, plate 12 is used to fasten support plate 30 directly to a backing 32 made of pressboard or similar material. Support plate 30 supports the mechanism of a binder clamp (not shown) or other similar binder devices. As discussed above, burst prongs embedded in backing 32 secure plate 12 to the backing without being visible on the opposite side. Deformable rivet 12*f* is provided to secure support plate 30 to plate 12. Rivet 12*f* may be formed integrally with plate 12 or it may be swaged in place on plate 12 as explained above. In order to accommodate the relative thinness of support plate 30, rivet 12*f* is relatively short in height. In this instance recess 12*c*′ passes completely through the rivet.

What is claimed is:

1. In a ring binder assembly having a spine, an arcuate ring casing having an arcuate portion with spaced apart holes therein, and ring halves for holding sheets of paper, the improvement comprising:

(a) a plate assembly including a plate having prongs which prongs are driven into the spine;

(b) an upstanding rivet mounted on the plate having a deformable upper head extending through an opening in the arcuate ring casing; and (c) the deformable upper head deformed to hold the arcuate ring casing in a spaced-apart position above the spine.

2. The ring binder assembly of claim 1 having two spaced apart blade assemblies.

3. The ring binders assembly of claim 2 in which an upstanding rivet includes a collar and a deformable portion at the end of the rivet opposite the deformable upper head which deformable portion is deformed to secure the rivet to one of the plates of the plate assemblies.

4. The ring binder assembly of claim 1 in which a spacer element is concentric with the rivet between the arcuate ring casing and the plate.

5. The ring binder assembly of claim 4 in which the spacer element is a tubular piece concentrically positioned around the upstanding rivet to serve as an anvil support while the head is deformed.

6. The ring binder assembly of claim 1 in which the spine is layered.

7. A binder assembly, comprising:

a) a backing having a first side and a second side;

b) a plate having prongs which are driven into the first side of the backing to secure said plate to said first side, without said prongs being visible on the second side of the backing;

c) an upstanding rivet mounted on the plate having a deformable upper head; and d) means for supporting a binder mechanism, said means including a member defining a hole with said rivet extending through said hole and said deformable upper head being deformed to secure said support means to the plate, whereby a binder mechanism is secured to the backing.

8. The binder assembly of claim 7, wherein the backing is laminated, comprising at least two layers.

9. The binder assembly of claim 7, wherein said member is a flat plate.

10. The binder assembly of claim 7, wherein said member is an arcuate casing of a ring binder assembly.

11. The binder assembly of claim 10, further comprising a tubular spacer element placed over the upstanding rivet to support said arcuate casing spaced from the plate.

12. The binder assembly of claim 7, wherein the backing comprises a spine of the binder.

13. The binder assembly of claim 7, wherein the backing comprise a cover of the binder.

* * * * *